US008726767B2

(12) United States Patent
Flamion

(10) Patent No.: US 8,726,767 B2
(45) Date of Patent: May 20, 2014

(54) VALVE WRENCHES

(75) Inventor: Brandon Richard Flamion, Georgetown, KY (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 140 days.

(21) Appl. No.: 13/048,137

(22) Filed: Mar. 15, 2011

(65) Prior Publication Data

US 2012/0234140 A1 Sep. 20, 2012

(51) Int. Cl.
*B25B 13/28* (2006.01)

(52) U.S. Cl.
CPC ..... *B25B 13/28* (2013.01)
USPC ..... 81/99; 81/92; 81/111

(58) Field of Classification Search
CPC ..... B25B 13/28
USPC ..... 81/90.1, 64, 133, 92–105, 111
See application file for complete search history.

(56) References Cited

U.S. PATENT DOCUMENTS

| | | | | |
|---|---|---|---|---|
| 3,635,104 | A | 1/1972 | Taylor et al. | |
| 3,774,480 | A | 11/1973 | Taylor et al. | |
| 3,949,439 | A | 4/1976 | Ardis | |
| 4,741,060 | A | 5/1988 | Hose | |
| 5,050,464 | A * | 9/1991 | Hurtig | 81/90.1 |
| 5,247,715 | A | 9/1993 | Nishiguchi | |
| 6,076,435 | A | 6/2000 | White, Sr. et al. | |
| 6,089,129 | A * | 7/2000 | Huang | 81/133 |
| 6,450,069 | B1 | 9/2002 | Brahmbhatt | |
| D472,777 | S | 4/2003 | Halstead | |
| 6,899,001 | B1 | 5/2005 | Sanders et al. | |
| 2003/0190572 | A1 | 10/2003 | Paleno et al. | |
| 2006/0156474 | A1 | 7/2006 | Gillingham | |

* cited by examiner

*Primary Examiner* — Lee D Wilson
*Assistant Examiner* — Danny Hong
(74) *Attorney, Agent, or Firm* — Dinsmore & Shohl LLP

(57) ABSTRACT

In one embodiment, a valve wrench for rotating a knob may include a handle and a jaw assembly coupled to the handle. The jaw assembly may include a fulcrum member, a hook member and a bias member. The hook member may be pivotably coupled to the fulcrum member and may be aligned to the fulcrum member at a pivot angle. The fulcrum member and the hook member can form an opening there between to accept the knob. The bias member may be disposed between the fulcrum member and the hook member to bias the hook member towards the fulcrum member when the jaw assembly is engaged with the knob.

19 Claims, 6 Drawing Sheets

VALVE WRENCHES

TECHNICAL FIELD

The present specification generally relates to wrenches for rotating objects and, more specifically, valve wrenches for rotating valves.

BACKGROUND

As background, compressed gas may be stored in a pressurized tank having a manually actuated valve. The flow of the compressed gas through the manually actuated valve is typically controlled by a knob. Most knobs are formed from a rigid material such as cast iron or hardened plastic and comprise multiple lobes. When the manually actuated valve is actuated by users of varying strength, a rigid knob with multiple lobes may not be suitable for repeated and consistent actuation. For example, if the manually actuated valve is over-tightened by a relatively strong user, a relatively weak user may not have the manual dexterity to loosen the manually actuated valve.

Accordingly, a need exists for alternative valve wrenches for rotating valves.

SUMMARY

In one embodiment, a valve wrench for rotating a knob may include a handle and a jaw assembly coupled to the handle. The jaw assembly may include a fulcrum member, a hook member and a bias member. The hook member may be pivotably coupled to the fulcrum member and may be aligned to the fulcrum member at a pivot angle. The fulcrum member and the hook member can form an opening there between to accept the knob. The bias member may be disposed between the fulcrum member and the hook member to bias the hook member towards the fulcrum member when the jaw assembly is engaged with the knob.

In another embodiment, a valve wrench for rotating a knob may include a handle and a jaw assembly coupled to the handle. The jaw assembly may include a hook member pivotably coupled to a fulcrum member and a bias member disposed between the hook member and the fulcrum member. The hook member may be aligned to the fulcrum member at a pivot angle. When the fulcrum member and the hook member are engaged with the knob and the valve wrench is rotated in a tightening direction, the pivot angle may be increased. When the fulcrum member and the hook member are engaged with the knob and the valve wrench is rotated in a loosening direction, the pivot angle may be decreased.

In yet another embodiment, a valve wrench for rotating a knob may include a handle and a jaw assembly coupled to the handle. The jaw assembly may include a fulcrum member, a hook member and a tool locating member. The hook member may be pivotably coupled to the fulcrum member and may be aligned to the fulcrum member at a pivot angle. The fulcrum member and the hook member can form an opening there between to accept the knob. The tool locating member may be coupled to a top side of the hook member and may extend at least partially over the opening, wherein a point of ingress to the opening is blocked and the valve wrench is unidirectional.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Figure 1:
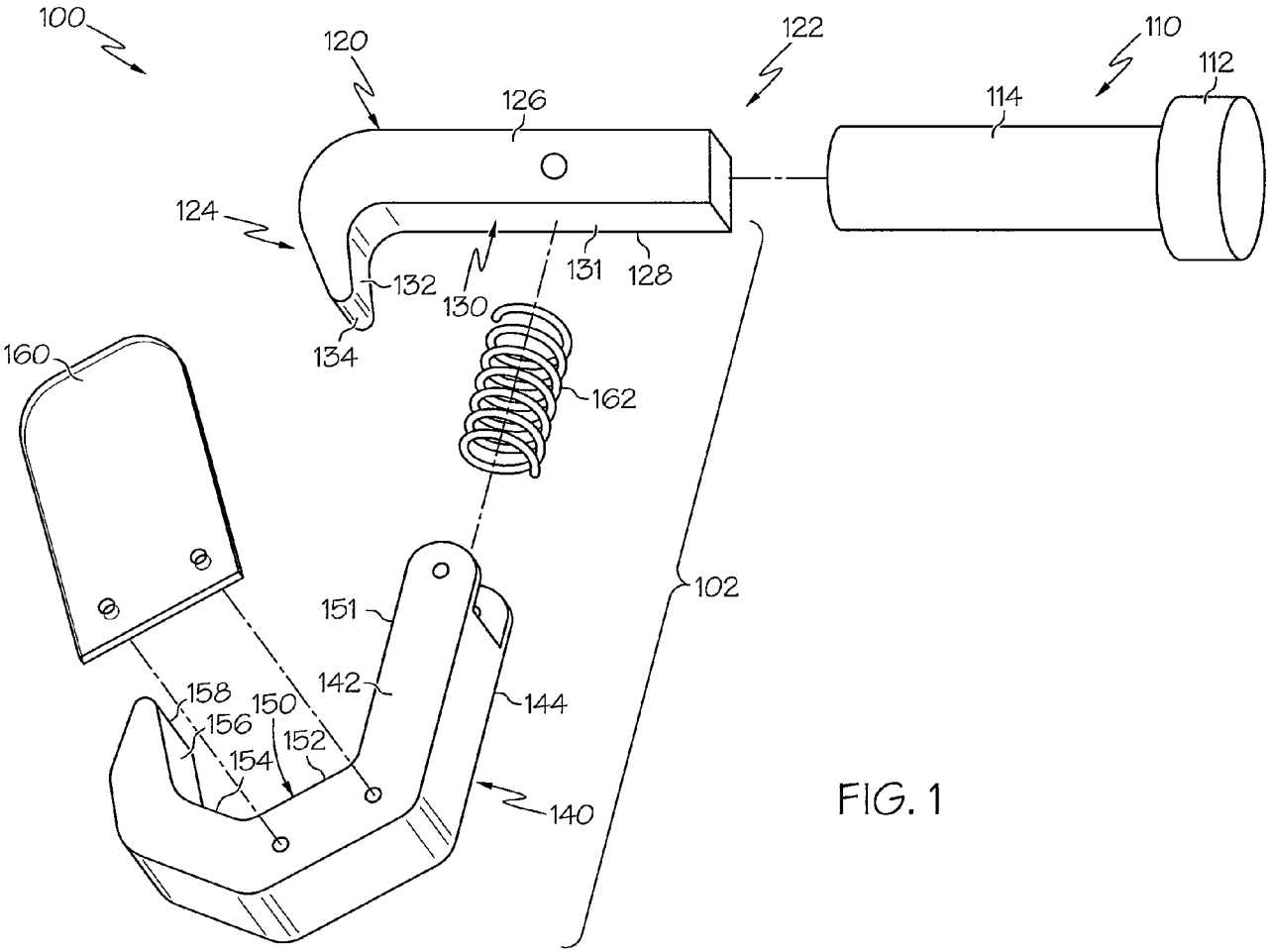
FIG. 1 schematically depicts an exploded view of a valve wrench according to one or more embodiments shown and described herein.

FIG. 1 generally depicts one embodiment of a valve wrench for rotating a knob. The valve wrench generally comprises a handle coupled to a jaw assembly comprising a fulcrum member pivotably engaged with a hook member. Various embodiments of the valve wrench and the operation of the valve wrench will be described in more detail herein.

Referring now to FIG. 1, the valve wrench 100 (illustrated in exploded form) for rotating a knob may comprise a handle 110. As used herein, the term knob refers to any rotatable object such as, for example, a knob with multiple lobes, a spigot, a handle and the like.

The handle 110 may comprise a lower portion 112 and an elongate portion 114 which cooperate to provide an area configured to be grasped or held by a hand. The lower portion 112 may be a substantially cylindrical body that is joined to the elongate portion 114, which may also be a substantially cylindrical body. The lower portion 112 and the elongate portion 114 may be joined permanently (e.g., attached via weld or adhesive), releasably coupled or integral. In one embodiment, the lower portion 112 may be larger than the elongate portion 114 to support a hand grasping the elongate portion 114. In another embodiment, the elongate portion 114 may be covered with a friction enhancement (e.g., knurling) to increase the friction between a hand grasping the handle 110 relative to an elongate portion 114 without the friction enhancement. Additionally, it is noted that, while the lower portion 112 and the elongate portion 114 are depicted as having a substantially circular cross-section, the lower portion 112 and the elongate portion 114 may have any cross-sectional shape such as, for example, square, rectangle, oval, a polygon and the like.

Figure 2:
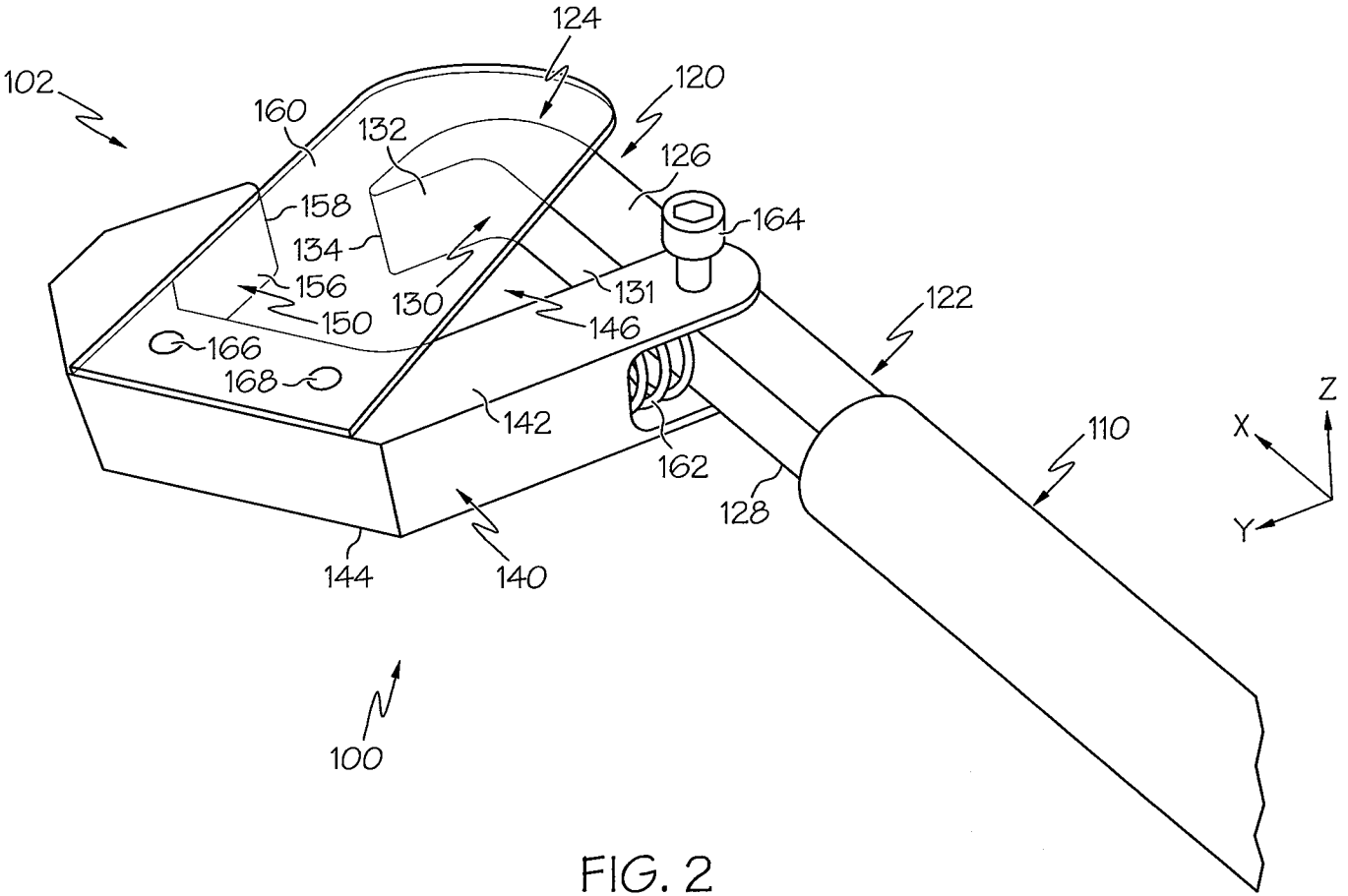
FIG. 2 schematically depicts a valve wrench according to one or more embodiments shown and described herein.

Referring now to FIGS. 1 and 2, the valve wrench 100 may comprise a jaw assembly 102 coupled to the handle 110. The jaw assembly 102 may comprise a fulcrum member 120 and a hook member 140. The hook member 140 may be pivotably coupled to the fulcrum member 120 and may be aligned to the fulcrum member 120 at a pivot angle $\alpha_2$. Specifically, the hook member 140 may be pivotably coupled to the fulcrum member 120 with a fastener 164 such as, for example, a bolt, a rivet, a pin and the like.

The fulcrum member 120 may provide leverage for turning a knob when the valve wrench 100 is engaged with the knob. The fulcrum member 120 may have a proximal end 122 that demarcates the nearest edge of the fulcrum member 120 and a distal end 124 that demarcates the furthest edge of the fulcrum member 120. The hook member 140 may pivot with respect to a position along the fulcrum member 120 and between the proximal end 122 and the distal end 124. In some embodiments, the hook member 140 may be pivotably coupled to the fulcrum member 120 at a position about half way between the proximal end 122 and the distal end 124.

In one embodiment, the fulcrum member 120 comprises a fulcrum surface 130 that extends from a top portion 126 of the fulcrum member 120 to a bottom portion 128 of the fulcrum member 120. The fulcrum surface 130 may be segmented and comprise a plurality of segments. Specifically, the fulcrum surface 130 may comprise a first fulcrum segment 131 that intersects with a second fulcrum segment 132 that extends to a rounded fulcrum surface 134. In another embodiment, the fulcrum surface 130 may be a substantially smooth surface or any other shape for pivoting about a knob engaged with the valve wrench 100.

Figure 3:
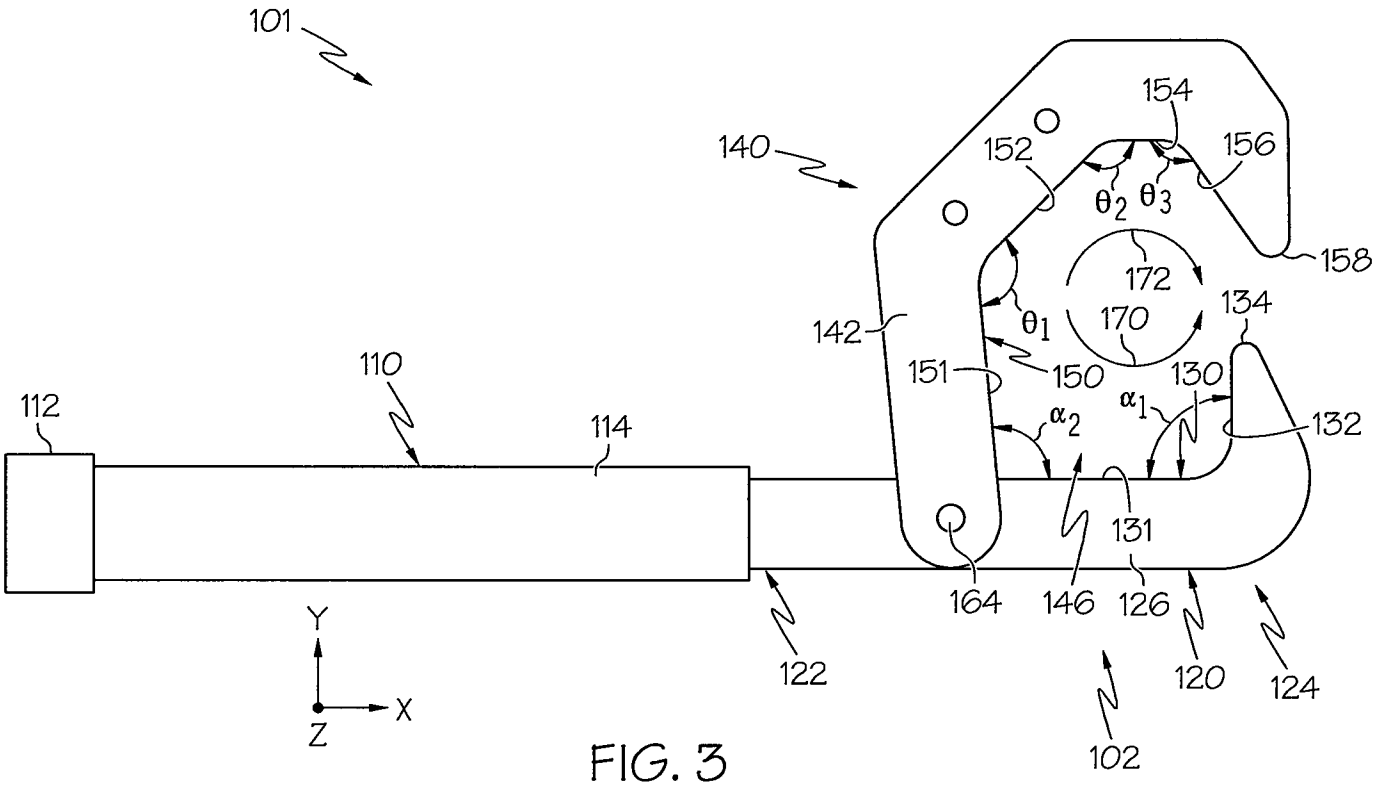
FIG. 3 schematically depicts a valve wrench according to one or more embodiments shown and described herein.

Referring to FIGS. 1 and 3, the distal end 124 of the fulcrum member 120 may comprise the first fulcrum segment 131 which may intersect the second fulcrum segment 132 at a fulcrum angle $\alpha_1$. The fulcrum angle $\alpha_1$ quantifies the amount of curve or bend in the fulcrum member 120. When the fulcrum angle $\alpha_1$ is substantially normal, the fulcrum member 120 may provide relatively good leverage for turning. Thus, the fulcrum angle $\alpha_1$ may be any angle from about 80° to about 100° such as, for example, any angle from about 85° to about 95° or about 90°. In further embodiments, the fulcrum angle $\alpha_1$ may be varied to any angle sufficient to promote a pivoting engagement between the fulcrum surface 130 and a knob engaged with the valve wrench 100.

The hook member 140 may provide a clamping force for turning a knob engaged with the valve wrench 100. Specifically, the hook member 140 may be curved to provide surfaces for contacting and/or clamping a knob. In one embodiment, the hook member 140 may comprise a hook surface 150 that extends from a top side 142 of the hook member 140 to a bottom side 144 of the hook member 140. The hook surface 150 may be segmented and comprise a plurality of segments.

In one embodiment, depicted in FIG. 3, the hook surface 150 comprises a first hook segment 151, a second hook segment 152, a third hook segment 154, a fourth hook segment 156, and a rounded hook surface 158. The first hook segment 151 may intersect the second hook segment 152 at a first hook angle $\theta_1$. The second hook segment 152 may intersect the third hook segment 154 at a second hook angle $\theta_2$. The third hook segment 154 may intersect the fourth hook segment 156 at a third hook angle $\theta_3$. The fourth hook segment 156 may extend to a rounded hook surface 158. The first hook angle $\theta_1$, the second hook angle $\theta_2$, and the third hook angle $\theta_3$ may be obtuse. In another embodiment, the first hook angle $\theta_1$, the second hook angle $\theta_2$, and the third hook angle $\theta_3$ may be substantially equal. In further embodiments, the first hook angle $\theta_1$ may be any angle from about 130° to about 150°, the second hook angle $\theta_2$ may be any angle from about 130° to about 150°, and/or the third hook angle $\theta_3$ may be any angle from about 130° to about 150°. In an alternative embodiment, the first hook angle $\theta_1$ may be about 138°, the second hook angle $\theta_2$ may be about 138°, and the third hook angle $\theta_3$ may be about 140° to provide substantial utility for clamping and rotating a knob. In still further embodiments, the hook surface 150 may comprise any number of facets or one or more substantially continuous curves suitable to provide contact and/or clamping force to a knob.

The fulcrum member 120 and the hook member 140 of the jaw assembly 102 may form an opening 146 there between to accept a knob. In some embodiments, the fulcrum surface 130 of the fulcrum member 120 and/or the hook surface 150 of the hook member 140 may face the opening 146. Specifically, the opening 146 may be adjacent to and at least partially bounded by fulcrum surface 130 and the hook surface 150 such that the rounded fulcrum surface 138 is offset from the rounded hook surface 158.

The size of the opening 146 may be adjusted by altering the pivot angle $\alpha_2$. When the hook member 140 rotates in a clockwise direction 172 the pivot angle $\alpha_2$ may be decreased. Conversely, when the hook member 140 rotates in a counter-clockwise direction 170 the pivot angle $\alpha_2$ may be increased. In one embodiment, the rotation of the hook member 140 may be limited such that pivot angle $\alpha_2$ has a maximum of about 140° and/or a minimum of about 65°.

It is noted that the handle 110, fulcrum member 120 and/or the hook member 140 may be formed from materials that are durable and substantially rigid with respect to the knob such as, for example, forged alloy steel, aluminum, cast iron, ABS plastic, PVC and the like. Additionally, it is noted that, while the fulcrum member 120 and the hook member 140 are depicted as having a substantially square cross-sections, the fulcrum member 120 and the hook member 140 may have any cross-sectional shape such as, for example, circle, rectangle, oval, a polygon and the like.

In one embodiment, the jaw assembly 102 may comprise a bias member 162 for enabling single-handed operation of the valve wrench 100. The bias member 162 may be any shape capable of biasing the hook member 140 to clamp a knob engaged with the jaw assembly 102 such as, for example, elongate, helical, conical, bowed, cantilevered and the like. Thus, while the bias member 162 is depicted in FIGS. 1 and 2 as being substantially helical, the shape of the bias member 162 is not so limited. Additionally, it is noted that, while the valve wrench 100 is depicted in FIGS. 1 and 2 as having one bias member 162, the embodiments described herein may comprise any number of bias members which may be integral with or separate elements coupled to the valve wrench 100. Furthermore, it is noted that the bias member 162 may comprise any flexible material such as, for example, metal, plastic and the like. In a further embodiment, the jaw assembly 102 may be configured for two-handed operation and not include any biasing member, i.e., operation may include a first hand holding the jaw assembly 102 closed and a second hand to rotating the valve wrench 100.

Referring back to FIGS. 1 and 2, the jaw assembly 102 may comprise an optional tool locating member 160 for aligning the valve wrench 100 with a knob. The tool locating member 160 may be any shape or size sufficient to extend from the fulcrum member 120 or the hook member 140 and at least partially cover the opening 146 to block a point of ingress to the opening 146. In one embodiment, the tool locating member 160 may be coupled to the top side 142 of the hook member 140 by fastener 166 and fastener 168 to extend over a portion of the opening 146. While the tool locating member 160 is depicted as being coupled to the top side 142 of the hook member 140, the tool locating member 160 may be coupled to other portions of the valve wrench 100 such as the bottom side 144 of the hook member 140, the top portion 126 of the fulcrum member 120 or the bottom portion 128 of the fulcrum member 102.

The tool locating member 160 may comprise any material sufficient the support the weight of the valve wrench 100 without being damaged such as, for example, lexan. It is noted that the larger the tool locating member 160 with respect to the opening 146, the greater the variety of differently sized and shaped knobs that may be aligned to the valve wrench 100. Furthermore, it is noted that the valve wrench 100 may be configured for unidirectional operation (e.g., effective for loosening and not for tightening, or effective for tightening and not for loosening) by positioning the tool locating member 160 over the opening 146, as is explained in further detail below. Alternative embodiments may be configured for bidirectional usage (effective for tightening and loosening) and may comprise a jaw assembly 102 without the optional tool locating member 160.

Referring now to FIGS. 2 and 3, the valve wrench 100 may comprise a jaw assembly 102 coupled to the handle 110. In one embodiment, the jaw assembly 102 may comprise the fulcrum member 120, the hook member 140 and the bias member 162. The bias member 162 may be disposed between the fulcrum member 120 and the hook member 140 to bias the hook member 140 with respect to the fulcrum member 120. Specifically, the bias member 162 may be disposed within a recess formed in the hook member 140. In further embodiments, the bias member 162 may be coupled the fulcrum member 120 and/or the hook member 140 at any location such that the bias member 162 biases the jaw assembly 102 to clamp a knob when the jaw assembly 102 is engaged with the knob.

The bias member 162 may also bias a hook member 140 to an equilibrium position, i.e., the position of the jaw assembly 102 when not engaged. Thus, the hook member 140 may be biased to remain at an equilibrium position absent forces external to the valve wrench 100. In a further embodiment, the bias member 162 may bias the hook member 140 to an equilibrium position such that the pivot angle $\alpha_2$ is about 80° to about 100° such as, for example, any angle from about 85° to about 95° or about 90°. In a further embodiment, the jaw assembly 102 may be unbiased and not configured to have an equilibrium position.

Figure 5:
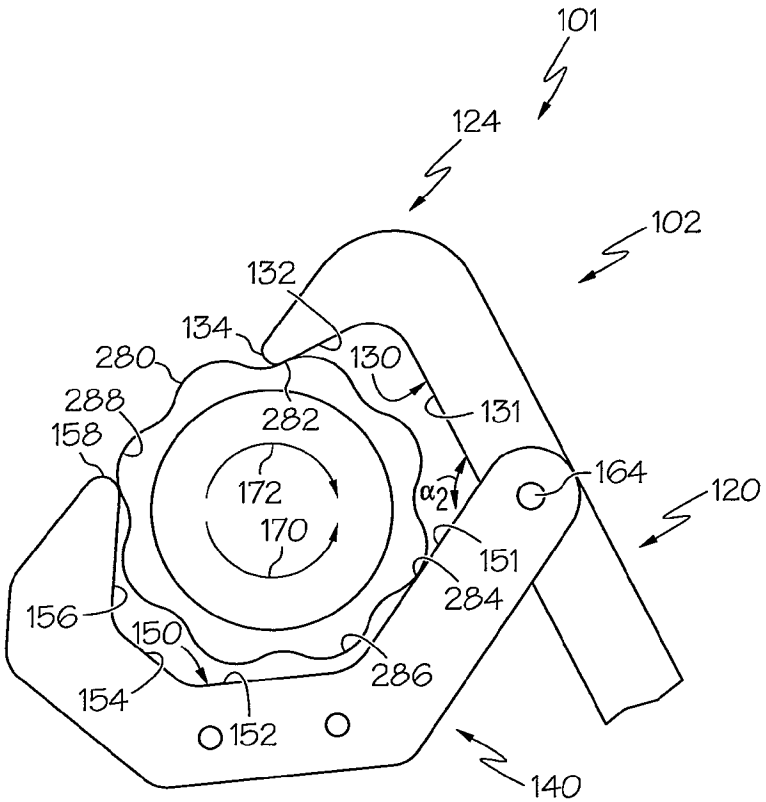
FIG. 5 schematically depicts a valve wrench engaged with a knob according to one or more embodiments shown and described herein.
Figure 4:
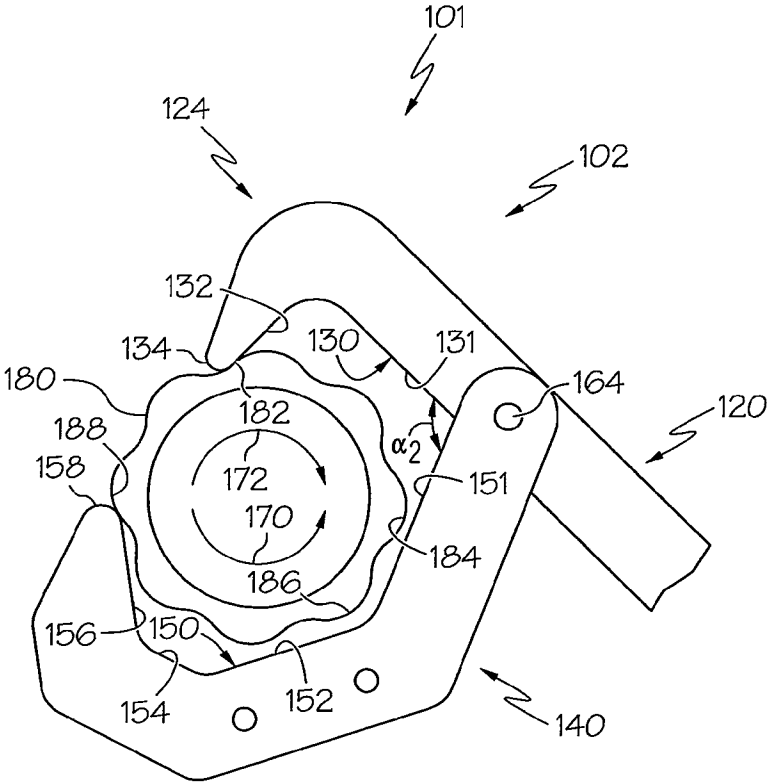
FIG. 4 schematically depicts a valve wrench engaged with a knob according to one or more embodiments shown and described herein.
Figure 6:
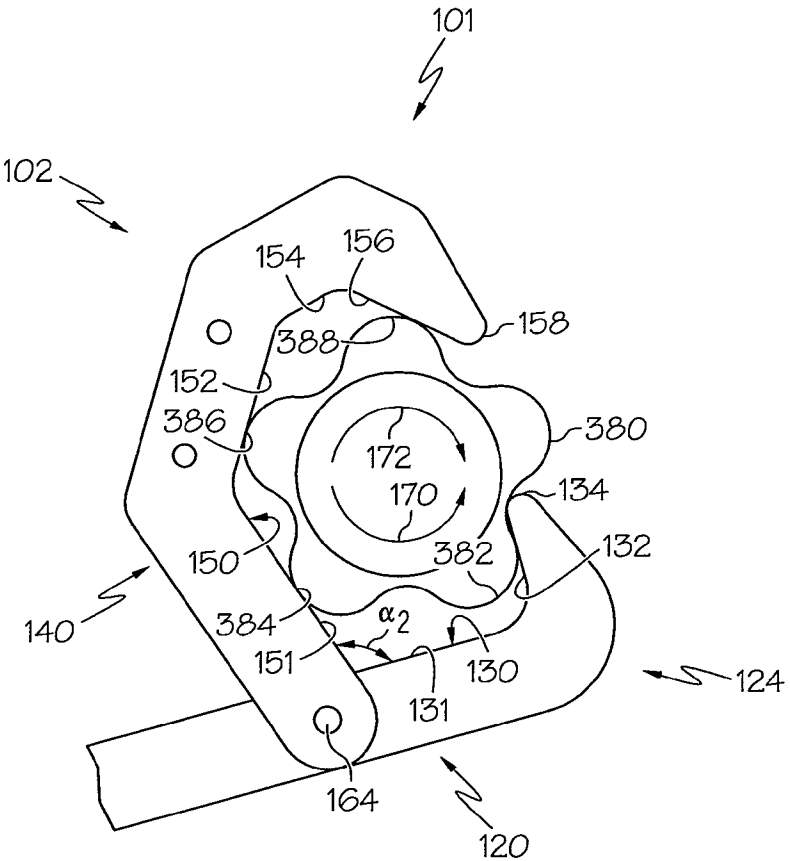
FIG. 6 schematically depicts a valve wrench engaged with a knob according to one or more embodiments shown and described herein.

Referring now to FIGS. 4-6, an embodiment of the valve wrench 101 may be utilized to rotate knobs of different sizes and shapes. For example, FIG. 4 depicts a valve wrench 100 engaged with a knob 180. When engaged, the fulcrum surface 130 and the hook surface 150 may be engaged with various lobes of the knob 180. Specifically, lobe 182 of the knob 180 may be in contact with the second fulcrum segment 132 of the fulcrum surface 130 and lobe 188 of the knob 180 may be in contact with the rounded hook surface 158 of the hook surface 150. While lobe 184 and lobe 186 of the knob 180 are not in contact with the jaw assembly 102. Thus, the jaw assembly 102 may engage the knob 180 through contact at two discrete points (i.e., lobe 182 and lobe 188).

FIG. 5 depicts the jaw assembly 102 engaged with a knob 280 which is larger than but similarly shaped as the knob 180 depicted in FIG. 4. When engaged, the fulcrum surface 130 and the hook surface 150 may be engaged with various lobes of the knob 280. Specifically, lobe 282 of the knob 280 may be in contact with the second fulcrum segment 132 of the fulcrum surface 130, lobe 286 of the knob 280 may be in contact with the first hook segment 151 of the hook surface 150, and lobe 288 of the knob 180 may be in contact with the rounded hook surface 158 of the hook surface 150. While lobe 286 of the knob 280 may not be in contact with the jaw assembly 102. Thus, the jaw assembly 102 may engage the knob 280 through contact at three discrete points (i.e., lobe 282, lobe 284 and lobe 288). Contrasting FIGS. 4 and 5, the larger knob 280 may be accommodated by increasing the opening 146, the pivot angle $\alpha_2$ and the number of discrete points of contact (from two to three).

FIG. 6 depicts a valve wrench 101 engaged with a knob 380 that is alternatively shaped as compared with the knob 180 depicted in FIG. 4. When engaged, the fulcrum surface 130 and the hook surface 150 may be engaged with various lobes of the knob 380. Specifically, lobe 382 of the knob 380 may be in contact with the second fulcrum segment 132 and the rounded fulcrum surface 134 of the fulcrum surface 130 and lobe 384 of the knob 380 may be in contact with the first hook segment 151 of the hook surface 150, lobe 386 may be in contact with the second hook segment 152 of the hook surface 150, and lobe 388 may be in contact with the fourth hook segment 156 of the hook surface 150. Thus, the jaw assembly 102 may engage the knob 180 through contact at four discrete points (i.e., lobe 382, lobe 384, lobe 386 and lobe 388). Contrasting FIGS. 4 and 6, the alternatively shaped knob 380 may be accommodated by decreasing the opening 146 and the pivot angle $\alpha_2$ and increasing the number of discrete points of contact (from two to four).

Referring collectively to FIGS. 4-6, embodiments of a valve wrench 101 may be configured for loosening and tightening an engaged knob. For example, as depicted in FIG. 4, the knob 180 may be loosened by rotating the engaged valve wrench 101 in the counter-clockwise direction 170. Specifically, when the fulcrum member 120 and the hook member 140 are engaged with the knob 180 and the valve wrench 101 is rotated in a loosening direction (counter-clockwise direction 170) the rotation may cause the pivot angle $\alpha_2$ to decrease. A decrease in pivot angle $\alpha_2$ may cause a corresponding increase in the clamping force applied by the jaw assembly 102 to the knob 180. That is, the decrease in pivot angle $\alpha_2$ may be limited by the knob 180 (e.g., the amount of force that loosens the knob 180 is greater than the force that decreases the pivot angle $\alpha_2$) or the pivot angle $\alpha_2$ decreases to a minimum pivot angle of about 65°. Once such a limit in the pivot angle $\alpha_2$ is reached, further rotation of the valve wrench 101 may cause the knob 180 to be loosened. It is noted that, the knob 180 may be tightened (i.e., rotated in a clockwise direction 172) with the valve wrench 101 by flipping the valve wrench 101 and engaging the knob 180 in a reverse direction.

Figure 7A:
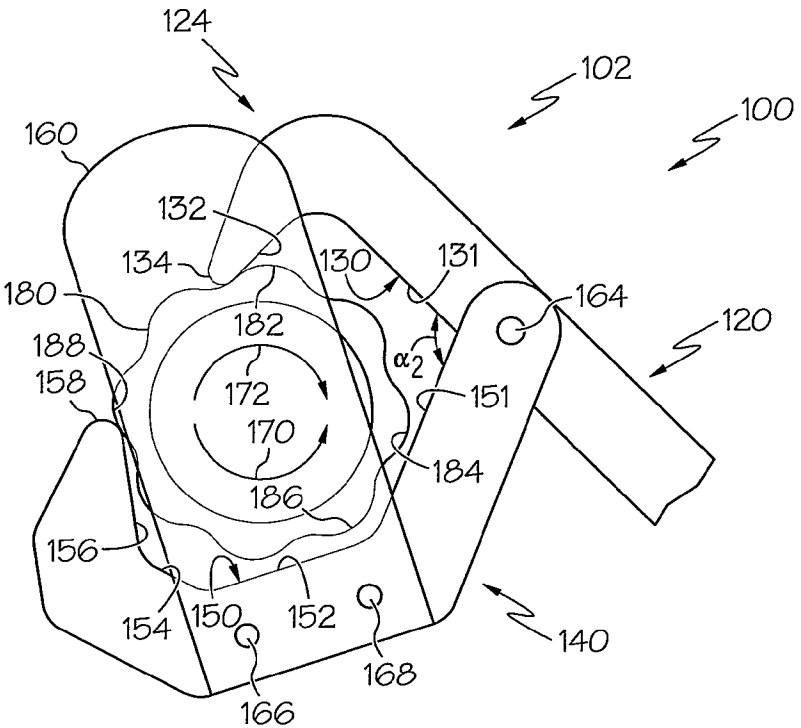
FIG. 7A schematically depicts a valve wrench engaged with a knob according to one or more embodiments shown and described herein.
Figure 7C:
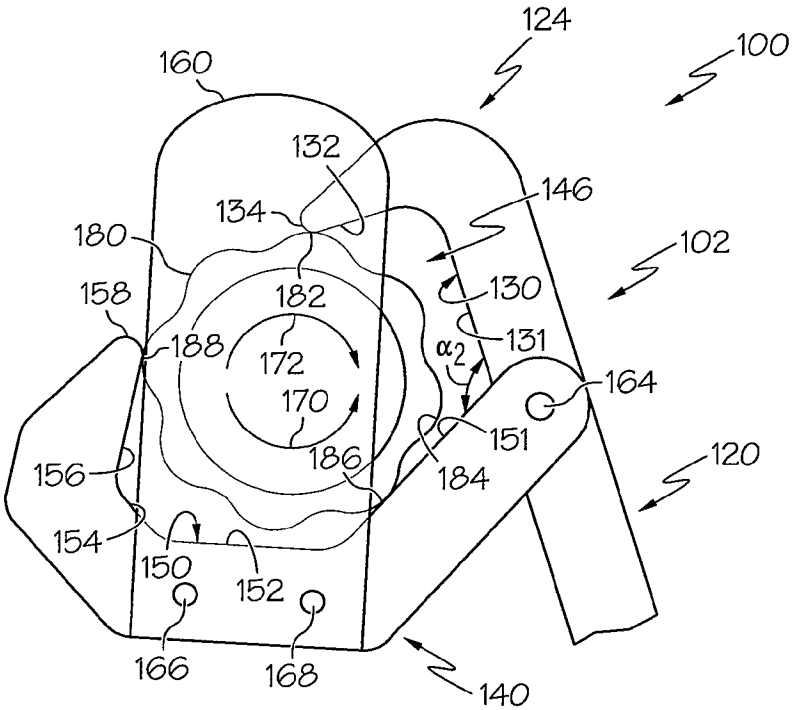
FIG. 7C schematically depicts a valve wrench engaged with a knob according to one or more embodiments shown and described herein.
Figure 7B:
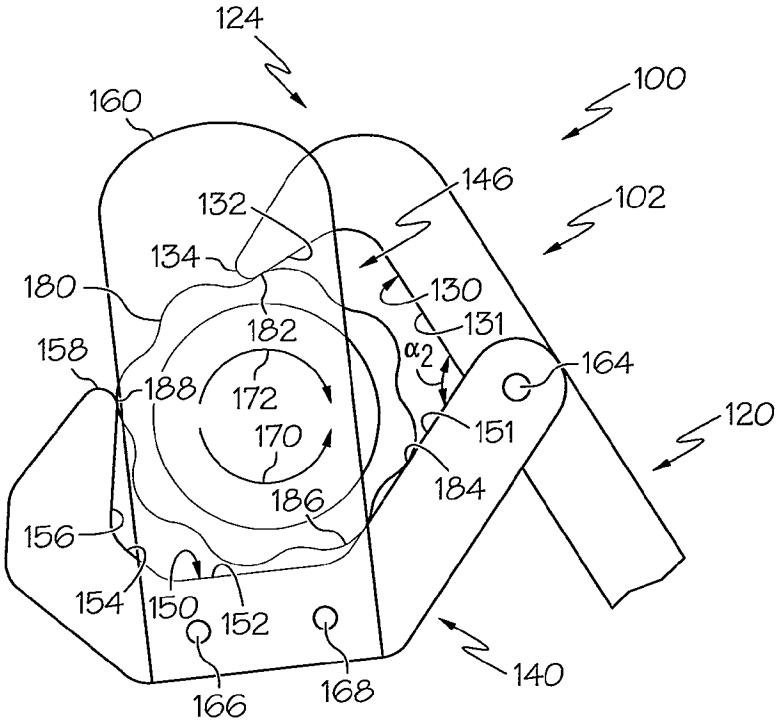
FIG. 7B schematically depicts a valve wrench engaged with a knob according to one or more embodiments shown and described herein.

Referring now to FIGS. 7A-7C, the disengagement of the valve wrench 100 from a knob 180 is depicted. As is described herein, the valve wrench 100 may comprise a jaw assembly 102 comprising a fulcrum member 120, a hook member 140 and a tool locating member 160. Referring to FIG. 7A, the valve wrench 100 may be engaged with the knob 180 by positioning the tool locating member 160 over and in contact with the knob 180 such that the knob 180 is located in the opening 146. When so positioned, lobe 182 of the knob 180 may be in contact with the second fulcrum segment 132 of the fulcrum surface 130 and lobe 188 of the knob 180 may be in contact with the rounded hook surface 158 of the hook surface 150. While lobe 184 and lobe 186 of the knob 180 may not be in contact with the jaw assembly 102. When so engaged, the knob 180 may be rotated in the counter-clockwise direction 170 (i.e., loosened) as is described above.

However, when so engaged, the jaw assembly 102 may disengage from the knob 180 when rotated in the clockwise direction 172 (i.e., tightened). Generally, when the amount of force needed to tighten the knob 180 is greater than the force that increases the pivot angle $\alpha_2$, the pivot angle $\alpha_2$ may increase. The force that increases the pivot angle $\alpha_2$ may be dependent upon the engagement between the knob 180 and the jaw assembly 102 and the amount of bias applied to the jaw assembly 102. When the pivot angle $\alpha_2$ is increased sufficiently, the jaw assembly 102 may become disengaged from the knob 180 (e.g., when the pivot angle $\alpha_2$ reaches a maximum pivot angle of about 140° the knob 180 may disengage).

FIG. 7B depicts an initial slippage between the jaw assembly 102 and the knob 180 as the jaw assembly 102 is rotated in the clockwise direction 172. As the jaw assembly 102 begins to slip along the knob 180, the pivot angle $\alpha_2$ may increase and the fulcrum surface 130 may slide along the lobe 182. At the increased pivot angle $\alpha_2$, lobe 182 of the knob 180 may slide along the fulcrum surface 130, lobe 184 and lobe 186 of the knob 180 may come into contact with the first hook segment 151 of the hook surface 150, and the rounded hook surface 158 of the hook surface 150 may slide along lobe 188.

FIG. 7C depicts further slippage between the jaw assembly 102 and the knob 180 as the jaw assembly 102 is rotated in the clockwise direction 172. As the pivot angle $\alpha_2$ continues to increase, the clamping force applied by the jaw assembly 102 to the knob 180 may decrease and the engagement between the two parts may become more tenuous. The pivot angle $\alpha_2$ may increase and the fulcrum surface 130 may slide along the lobe 182. At the increased pivot angle $\alpha_2$, lobe 182 of the knob 180 may be brought into contact with the rounded fulcrum surface 134, lobe 186 of the knob 180 may contact with the first hook segment 151 of the hook surface 150, and lobe 188 of the knob 180 may be brought into contact with the fourth hook segment 156. While lobe 184 may not be in contact with the jaw assembly 102. Any further rotation in the clockwise direction 172 may cause the jaw assembly 102 to disengage from the knob 180 because the engagement between the jaw assembly 102 and the knob 108 may be relatively weak (lower clamping force) compared to the engagement of FIG. 7A.

Referring again to FIG. 3, it is noted that directional terms such as "top," "bottom," "clockwise" and "counter-clockwise" are used herein for clarity. Such terms are intended to be interpreted with respect to the coordinate system (XYZ) provided herein. Furthermore it is contemplated that various alternative embodiments may be achieved by orienting the embodiments described herein in alternative directions with respect to the coordinate system. For example, embodiments of the valve wrench 101 may be used for tightening by rotating the valve wrench 180° about the X-axis. Further, embodiments with the tool locating member 160 coupled to the bottom side 144 of the hook member 140 may be utilized for tightening.

It should now be understood that the valve wrenches described herein may be utilized to tighten and/or loosen valves actuated by knobs of various shapes and sizes. For example, an assembly line may make use of compressed gas in a pressurized tank having a manually actuated valve controlled by a knob. Such knobs may be actuated by users of varying strength. Over-tightening may be prevented by a unidirectional valve wrenches configured for loosening. Manually actuated valves, which may be tight or over-tightened, may be loosened with minimal effort.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A valve wrench for rotating a knob comprising:
a handle;
a jaw assembly coupled to the handle, the jaw assembly comprising a fulcrum member, a hook member and a bias member, wherein:
the hook member is pivotably coupled to the fulcrum member and is aligned to the fulcrum member at a pivot angle;
the fulcrum member and the hook member form an opening there between to accept a knob;
the bias member is disposed between the fulcrum member and the hook member to bias the hook member towards the fulcrum member when the jaw assembly is engaged with the knob; and
a tool locating member having a first end and an opposite, second end, the first end of the tool locating member connected directly to the hook member and extending outwardly from the hook member and over the opening to the second end adjacent the fulcrum member without being connected directly thereto such that the hook member and the tool locating member move relative to the fulcrum member.

2. The valve wrench of claim 1 wherein the bias member biases the jaw assembly to an equilibrium position such that the pivot angle is about 80° to about 100°.

3. The valve wrench of claim 1 wherein the hook member rotates between a maximum pivot angle of about 140° and a minimum pivot angle of about 65°.

4. The valve wrench of claim 1 wherein a distal end of the fulcrum member comprises a fulcrum surface that faces the opening, the fulcrum surface forming a fulcrum angle of about 80° to about 100°.

5. The valve wrench of claim 1 wherein the hook member further comprises a hook surface that extends to a rounded hook surface such that the hook surface faces the opening and is contoured to clamp the knob.

6. The valve wrench of claim 5 wherein a distal end of the fulcrum member comprises a rounded fulcrum surface that is offset from the rounded hook surface and the rounded fulcrum surface and the rounded hook surface are adjacent to the opening.

7. The valve wrench of claim 5 wherein the hook surface comprises a first hook segment and a second hook segment that intersect at an obtuse angle.

8. A valve wrench for rotating a knob comprising:
a handle;
a jaw assembly coupled to the handle, the jaw assembly comprising a hook member pivotably coupled to a fulcrum member and a bias member disposed between the hook member and the fulcrum member, wherein the hook member is aligned to the fulcrum member at a pivot angle, such that:
when the fulcrum member and the hook member are engaged with a knob and the valve wrench is rotated in a tightening direction, the pivot angle is increased; and when the fulcrum member and the hook member are engaged with the knob and the valve wrench is rotated in a loosening direction, the pivot angle is decreased; and a tool locating member extending at least partially over an opening between the hook member and the fulcrum member, wherein when the tool locating member contacts the knob, the fulcrum member and the hook member are aligned with the knob, the tool member having a first end and an opposite, second end, the first end of the tool locating member connected directly to the hook member and extending outwardly from the hook member and over the opening to the second end adjacent the fulcrum member without being connected directly thereto such that the hook member and the tool locating member move relative to the fulcrum member.

9. The valve wrench of claim 8 wherein the pivot angle increases to a maximum pivot angle of about 140° to disengage the knob.

10. The valve wrench of claim 8 wherein the pivot angle decreases to a minimum pivot angle of about 65° to clamp the knob.

11. The valve wrench of claim 8 wherein a distal end of the fulcrum member comprises a fulcrum surface that faces an opening, the fulcrum surface forming a fulcrum angle of about 90°.

12. The valve wrench of claim 11 wherein the hook member comprises a hook surface that faces the opening and is segmented to grip the knob, the hook surface comprising a first hook segment and a second hook segment that intersect at a hook angle of about 130° to about 150°.

13. A valve wrench for rotating a knob comprising:

a handle;

a jaw assembly coupled to the handle, the jaw assembly comprising a fulcrum member, a hook member and a tool locating member, wherein:

the hook member is pivotably coupled to the fulcrum member and is aligned to the fulcrum member at a pivot angle;

the fulcrum member and the hook member form an opening there between to accept a knob; and the tool locating member is coupled to a top side of the hook member and extends at least partially over the opening, wherein a point of ingress to the opening is blocked and the valve wrench is unidirectional, the tool locating member having a first end and an opposite, second end, the first end of the tool locating member connected directly to the hook member and extending outwardly from the hook member and over the opening to the second end adjacent the fulcrum member without being connected directly thereto such that the hook member and the tool locating member move relative to the fulcrum member.

14. The valve wrench of claim 13 further comprising a bias member disposed between the fulcrum member and the hook member to bias the hook member away from the fulcrum member.

15. The valve wrench of claim 14 wherein the bias member biases the hook member such that the pivot angle is about 80° to about 100°.

16. The valve wrench of claim 15 wherein the hook member rotates between a maximum pivot angle of about 140° and a minimum pivot angle of about 65°.

17. The valve wrench of claim 16 wherein a distal end of the fulcrum member comprises a fulcrum surface that faces the opening, the fulcrum surface forming a fulcrum angle of about 80° to about 100°.

18. The valve wrench of claim 17 wherein the hook member further comprises a hook surface that extends to a rounded hook surface such that the hook surface faces the opening and is contoured to grip the knob.

19. The valve wrench of claim 1, wherein the tool locating member is connected to the hook member or the fulcrum member such that the other of the hook member or the fulcrum member moves aside the tool locating member to change a size of the opening.

* * * * *